US009006614B2

(12) United States Patent
Donarski

(10) Patent No.: US 9,006,614 B2
(45) Date of Patent: Apr. 14, 2015

(54) COOKING APPLIANCE AND METHOD FOR SAME

(75) Inventor: Robert S. Donarski, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 280 days.

(21) Appl. No.: 13/473,694

(22) Filed: May 17, 2012

(65) Prior Publication Data

US 2013/0306613 A1 Nov. 21, 2013

(51) Int. Cl.

| | |
|---|---|
| ***F24C 7/08*** | (2006.01) |
| ***F24C 5/16*** | (2006.01) |
| ***F24C 3/12*** | (2006.01) |
| ***H05B 3/74*** | (2006.01) |

(52) U.S. Cl.

CPC ..... *H05B 3/746* (2013.01); *F24C 3/126* (2013.01); *F24C 7/083* (2013.01); *F23N 2031/22* (2013.01)

(58) Field of Classification Search

None

See application file for complete search history.

(56) References Cited

U.S. PATENT DOCUMENTS

| | | | | |
|---|---|---|---|---|
| 3,852,728 | A * | 12/1974 | Flagg, Jr. | 340/655 |
| 3,909,812 | A * | 9/1975 | Satorius | 340/593 |
| 4,511,781 | A * | 4/1985 | Tucker et al. | 219/626 |
| 4,990,750 | A * | 2/1991 | Martel et al. | 219/445.1 |
| 6,861,628 | B2 * | 3/2005 | Owens et al. | 219/622 |
| 7,561,058 | B2 * | 7/2009 | Farley et al. | 340/635 |
| 2004/0112887 | A1 * | 6/2004 | Lerner | 219/445.1 |
| 2004/0238524 | A1 * | 12/2004 | Lerner | 219/445.1 |
| 2007/0290871 | A1 * | 12/2007 | Farley et al. | 340/635 |
| 2012/0132635 | A1 * | 5/2012 | Mishra | 219/209 |
| 2013/0306613 | A1 * | 11/2013 | Donarski | 219/209 |

FOREIGN PATENT DOCUMENTS

| | | | |
|---|---|---|---|
| EP | 0033499 | A2 * | 8/1981 |
| EP | 1255420 | A2 | 11/2002 |
| GB | 2065883 | A | 7/1981 |
| JP | 59109723 | A | 6/1984 |

OTHER PUBLICATIONS

EP0033499A2, Aug. 1981, Schilling et al, partial machine translation.*

EP1255420A2, Nov. 2002, Schneider, partial machine translation.*

European Application No. 13167168.7 / 2664855 filed May 9, 2013, Applicant: Whirlpool Europe Srl, European Search Report re:same, mail date: May 2, 2014.

* cited by examiner

*Primary Examiner* — Joseph M Pelham

(57) ABSTRACT

A cooking appliance have at least one burner operable in an ON condition for producing heat and an OFF condition for not producing heat and a Hot Surface Indicator having an illumination source that may be operated when the burner is not producing heat as well as a method for illuminating the Hot Surface Indicator.

21 Claims, 2 Drawing Sheets

COOKING APPLIANCE AND METHOD FOR SAME

BACKGROUND

Contemporary cooking appliances may include separate indicator lights for indicating that the cooktop is ON and another indicating that the cooktop is hot. To illuminate the cooktop hot light, the cooking appliance may include a set of thermally expanding contacts on each individual element and these contacts expand to close when the element is hot, completing the circuit, and open when the element is cool, opening the circuit. Such a method for illuminating the lights may be unreliable as over time the thermal expansion of the contacts may vary and can cause the light to be on for extended periods of time or even permanently. Some contemporary cooking appliances use a separate control board to indicate to the consumer that the cooktop is hot, but these are appliances in which expensive microcontrollers rather than less expensive rotary switches are used.

BRIEF SUMMARY

According to an embodiment of the invention, a method of illuminating a Hot Surface Indicator having an illumination source in a cooking appliance having at least one burner activated by a control selector operable between ON and OFF states includes storing electricity in an electricity storage device when the control selector is in the ON state and supplying electricity stored in the electricity storage device to the illumination source of the Hot Surface Indicator while the control selector is in the OFF state.

According to another embodiment of the invention, a cooking appliance includes at least one burner operable in an ON condition for producing heat and an OFF condition for not producing heat, a Hot Surface Indicator having an illumination source, an electricity storage device electrically coupled to the illumination source of the Hot Surface Indicator, a switch electrically coupling the storage device to an electricity source, and a control selector operable between an ON state for placing the burner in the ON condition and an OFF state for placing the burner in the OFF condition, and activating the switch to electrically couple the electricity source to the electricity storage device when the control selector is in the ON state.

DESCRIPTION OF EMBODIMENTS OF THE INVENTION

Figure 1:
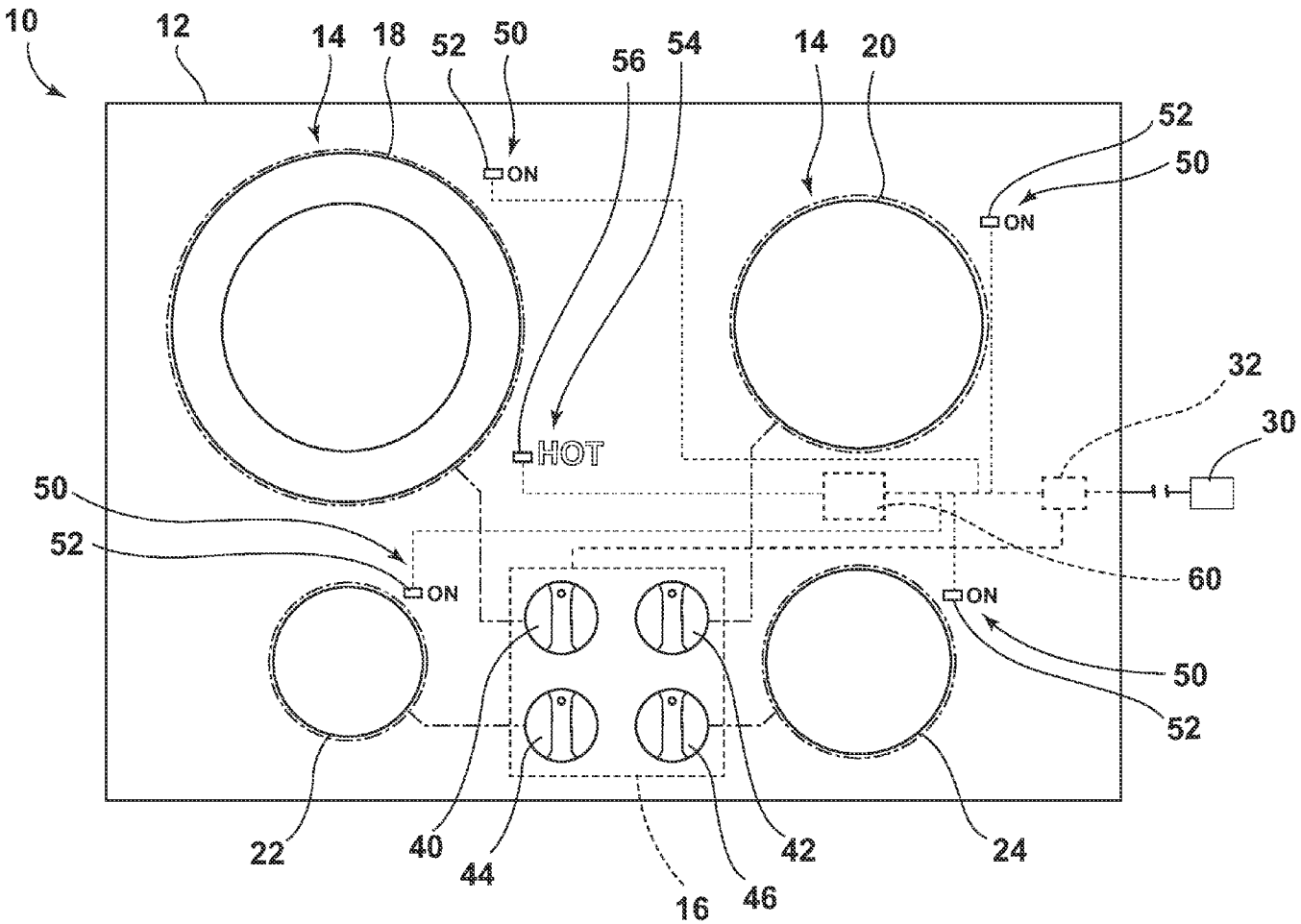
FIG. 1 is a schematic illustration of a cooktop for a cooking appliance according to an embodiment of the invention.

FIG. 1 is a schematic illustration of a cooking appliance 10 having a range or cooktop 12, which may include elements or burners 14 and a set of controls 16 used to control operation of the burners 14 by selecting the temperature settings therefor. While multiple burners 14 have been illustrated, it is contemplated that the cooktop 12 may have any number of burners 14 including a single burner 14. In the illustrated embodiment, the cooktop 12 includes burners 14 in the form of a left rear burner 18, a right rear burner 20, a left front burner 22, and a right front burner 24. The burners 14 may be supplied by electricity or gas. For example, the burners 14 may be interconnected to an electricity source or electric power supply 30 schematically illustrated via a switch 32 or the burners 14 may be interconnected to a gas supply line via a regulator and several valves (not shown). In both the electrically supplied and gas supplied embodiments, an electricity source or power supply 30 may be used and may be operably coupled to various elements of the cooking appliance 10 including the switch 32, a user display, a controller, etc.

Regardless of whether the burner 14 is supplied by a gas supply line or the electric power supply 30, the burners 14 may be operable in an ON condition for producing heat and an OFF condition for not producing heat. The set of controls 16 may include a control selector for each of the burners 14. More specifically, control selectors 40, 42, 44, and 46, may be operably coupled to the left rear burner 18, right rear burner 20, left front burner 22, and right front burner 24, respectively, to control the operation thereof. Each of the control selectors 40, 42, 44, and 46 may be operable between an ON state for placing the respective burner in the ON condition and an OFF state for placing the respective burner in the OFF condition.

An On Indicator 50 may be adjacent each of the burners 14. The ON Indicators 50 may each include an illumination source 52, which may be used to indicate when each of the burners 14 is in the ON state. The illumination sources 52 may each be electrically coupled to the electric power supply 30 by the switch 32. The illumination sources 52 may include any suitable type of light or illumination source including an incandescent lamp, a light emitting diode (LED), or an array of several LEDs.

Further, a Hot Surface indicator 54 may be located on the cooktop 12. The Hot Surface indicator 54 may include an illumination source 56, which may be used to indicate that at least one of the burners 14 is hot and should not be touched. The illumination source 56 may preferably include an LED or an array of several LEDs.

An electricity storage device 60 may be included in the cooking appliance 10 and may be electrically coupled to the electric power supply 30 and configured to illuminate the illumination source 56 of the Hot Surface Indicator 54. The electricity storage device 60 may be any suitable device capable of storing electricity. For example, the electricity storage device 60 may include a capacitor or the electricity storage device 60 may include a resistor-capacitive circuit (RC circuit) and a capacitor may form part of the RC circuit. The electricity storage device 60 may subsequently supply the stored electricity to the illumination source 56 of the Hot Surface Indicators 54, either directly or indirectly, while the burners 14 are in the OFF state to illuminate the Hot Surface Indicator 54. Alternatively, the electricity storage device 60 may illuminate the illumination source 56 of the Hot Surface Indicator 54 by supplying a control signal to a power source to illuminate the illumination source 56 of the Hot Surface Indicator 54.

Regardless of the type of electricity storage device 60, the electricity storage device 60 may be sized to store an amount of electricity for the illumination source 56 of the Hot Surface Indicator 54 to remain illuminated until the burner 14 is cool enough to touch after the respective one of the control selectors 40, 42, 44, and 46 is moved from the ON state to the OFF state. The electricity storage device 60 may be sized for the illumination source 56 of the Hot Surface Indicator 54 to remain illuminated until the respective burner 14 is in the range of 25° C. to 65° C. Such a size calculation may be calculated based on a highest temperature the burners 14 are capable of reaching. For example, at such a highest temperature it may be known that the burners 14 take 5-10 minutes to cool down after the burners 14 are turned off and the electricity storage device 60 may be sized based thereon. By way of non-limiting example, it is contemplated that the electricity storage device 60 may be capable of storing up to 12 V, which may be an amount of electricity for the illumination source 56 of the Hot Surface Indicator 54 to remain illuminated by the stored electricity until the burner 14 is cool enough to touch.

The control selectors 40, 42, 44, and 46 may be operably coupled to the switch 32 such that when one of the control selectors 40, 42, 44, and 46 is turned to an ON state the control selector may activate the switch 32 to electrically couple the electric power supply 30 to the electricity storage device 60. In operation, when one of the control selectors 40, 42, 44, and 46 is in the ON state, the switch 32 electrically couples the electric power supply 30 to the illumination source 52 of the ON Indicator 50 such that electricity is supplied to the illumination source 52. While electricity is being supplied to the illumination source 52 for the ON Indicator 50, electricity may also be supplied to the electricity storage device 60, where it is stored for subsequent use. Thus, electricity may be stored in the electricity storage device 60 when one of the control selectors 40, 42, 44, and 46 is in the ON state. Electricity may begin to be stored as soon as any burner 14 is turned on and the appropriate amount of electricity may be stored in the electricity storage device 60 in the time it takes for the burner 14 to heat to a temperature not suitable for touching.

A timer (not shown) may be included and used to set the time at which the illumination source 56 of the Hot Surface Indicator 54 will come on. For example, such a timer may include a 555 timer or a 741 op-amp and such time may range from zero to fifteen seconds. For burners 14 connected to a gas supply the illumination source 56 of the Hot Surface Indicator 54 may be configured to come on more quickly than for a burner 14 supplied by electricity as the burner 14 supplied by gas may heat up faster. By way of non-limiting example, the illumination source 56 of a gas supplied burner 14 may come on between 0-5 seconds while the illumination source 56 of an electrically supplied burner 14 may come on between 5-15 seconds.

When the user is done with the burner 14, the respective one of the control selectors 40, 42, 44, and 46 may be turned to the OFF state such that electricity will no longer supplied to the illumination source 52 for the ON Indicator 50. However, stored electricity may be supplied to illuminate the illumination source 56 of the Hot Surface Indicator 54.

In the case where the electricity storage device 60 supplies power to the illumination source 56 and includes an RC circuit, the RC circuit may provide voltage to the illumination source 56 of the Hot Surface Indicator 54 so that the illumination source 56 may remain illuminated by the stored electricity until the burner 14 is cool enough to touch after the control selector is moved to the OFF state. The voltage in the electricity storage device 60 will begin to deplete as power is dissipated through the illumination source 56 of the Hot Surface Indicator 54. The illumination source 56 of the Hot Surface Indicator 54 will remain lit until the voltage in the electricity storage device 60 depletes to a level where the illumination source 56 of the Hot Surface Indicator 54 will no longer illuminate. By way of non-limiting example, a potential value for the rate of depletion may be 1 V/min but such a rate may vary depending on the type and size of illumination source 56 used. The values of the electricity storage device 60 and the RC circuit can be chosen or tuned to allow for a predetermined ON time sufficient to cool down the burners 14.

Further, it is contemplated that when the illumination source 56 of the Hot Surface Indicator 54 is illuminated, the electricity storage device 60 may not have reached its full capacity. The electricity storage device 60 may be configured to continue to charge until it reaches the maximum storage capacity for which it is designed. By way of non-limiting example, it may take a few extra seconds to store the amount of electricity needed for the electricity storage device 60 to reach full capacity.

The electricity storage device 60 may include a timing circuit to control the supply of electricity from the electricity storage device 60 to the illumination source 56 of the Hot Surface Indicator 54. Such a timing circuit may signal the illumination source 56 of the Hot Surface Indicator 54 to turn off when electricity storage device 60 falls below a specified voltage. For example, if electricity storage device 60 holds 12 V when fully charged, the timing circuit may be configured to shut of the illumination source 56 of the Hot Surface Indicator 54 when the electricity storage device 60 has depleted to below 7 V. For example, a 555 timer or a 741 op-amp may be used to control the supply of electricity to the illumination source 56.

Figure 2:
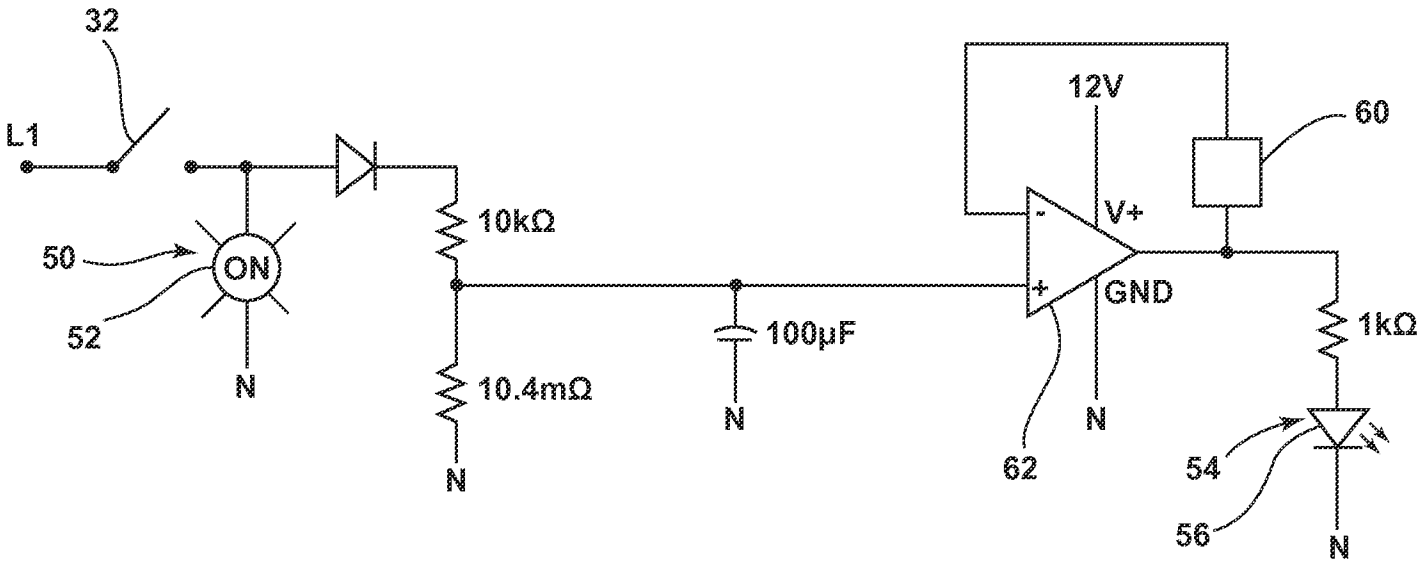
FIG. 2 is a schematic illustration of a control circuit, which may be used in the cooking appliance of FIG. 1 according to an embodiment of the invention.

It is also contemplated that the electricity stored in the electricity storage device 60 may be used to illuminate the illumination source of the Hot Surface Indicator by supplying a control signal to a power source. FIG. 2 is a diagram of an exemplary control circuit, which may be used in the cooking appliance 10 according to an embodiment of the invention and includes an op-amp 62. The diagram illustrates an electricity storage device 60 and the op-amp 62, which may power an LED forming the illumination source 56. It is illustrated that a 12V power supply is supplied to the op-amp 62, such a 12V power supply may be considered to be always on or present as a supply to the op-amp 62, even after all of the control selectors have been switched to the off state. The 12V supply may come from the electric power supply 30. After the switch 32 is turned off, the duration of time the LED illumination source 56 is on may be determined by the time constant of the system. The time constant is a function of the resistance and capacitance of the circuitry. The op-amp 62 may also be used to mitigate undesired effects that can occur when mismatched loads are connected.

More specifically, the control circuitry illustrated may be used in the instance where the electricity storage device 60 is not large enough to power the illumination source 56 of the Hot Surface Indicator 54 for a long enough time period for the burners to sufficiently cool. The stored electricity in the electricity storage device 60 acts as a control signal input to the op amp 62 and the output of the op-amp 62 in turn powers the illumination source 56 of the Hot Surface Indicator 54. The op-amp 62 may act as an amplifier to amplify the stored electricity supplied to the illumination source 56 of the Hot Surface Indicator 54 and a switch that is responsive to the control signal. In this manner, the stored electricity in the electricity storage device 60 controls the supply of electricity from the power source to the illumination source 56 of the Hot Surface Indicator 54 while the control selector is in the off state.

The above described embodiments provided a variety of benefits including that the illumination source of the Hot Surface Indicator may be powered for a long enough time to allow for the respective burner to cool down. In this manner, the hot surface indicator is no longer relying on the individual element to energize and de-energize the illumination source. This eliminates reliability issues and cost associated with individual wiring or microprocessors used to illuminate the Hot Surface Indicator.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims. For example, a Hot Surface indicator may be located adjacent each of the burners and each of the Hot Surface indicators may include an illumination source. In such an instance multiple electricity storage devices may be included in the cooking appliance such that each of illumination sources for the various burners may be operably coupled to a separate suitably sized electricity storage device capable of illuminating the illumination source after the respective burner has been turned off.

What is claimed is:

1. A method of illuminating a Hot Surface Indicator having an illumination source in a cooking appliance having at least one burner activated by a control selector operable between ON and OFF states, the method comprising:

providing electricity from a power source when the control selector is in the ON state;

storing a predetermined amount of electricity, provided by the power source, in an electricity storage device, which is sized to store the predetermined amount of electricity based on illuminating the illumination source until the at least one burner is in a predetermined temperature range, when the control selector is in the ON state; and supplying the predetermined amount of electricity stored in the electricity storage device until the electricity in the electricity storage device is depleted, to indirectly or directly illuminate the illumination source of the Hot Surface Indicator while the control selector is in the OFF state;

wherein the illumination of the illumination source of the Hot Surface Indicator is powered by the electricity storage device independent of an actual temperature of a portion of the cooking appliance after a change in state from ON to OFF of the control selector.

2. The method of claim 1 wherein supplying the predetermined amount of electricity stored in the electricity storage device comprises the electricity storage device supplying a control signal to a power source to supply power to the Hot Surface indicator.

3. The method of claim 2 wherein the power source supplies electricity to the illumination source of the Hot Surface Indicator while the control selector is in the OFF state.

4. The method of claim 3 wherein the power source comprises a switch responsive to the control signal.

5. The method of claim 4 wherein the switch comprises an amplifier to amplify the electricity supplied from the power source to the illumination source of the Hot Surface Indicator.

6. The method of claim 1 wherein when the control selector is in the ON state, electricity is supplied to an illumination source for an ON Indicator.

7. The method of claim 6 wherein the supplying of electricity to the illumination source for the ON Indicator further comprises supplying electricity to the electricity storage device for storing.

8. The method of claim 7 wherein when the control selector is in the OFF state, electricity is no longer supplied to the illumination source for the ON Indicator.

9. The method of claim 1 wherein the storing electricity comprises storing an amount of electricity for the illumination source of the Hot Surface Indicator to remain illuminated by the stored electricity until the burner is cool enough to touch after the control selector is moved from the ON state to the OFF state.

10. The method of claim 9 wherein the storing the predetermined amount of electricity comprises storing the predetermined amount of electricity in a time it takes for the burner to heat to a temperature not suitable for touching.

11. The method of claim 1 wherein the supplying the predetermined amount of electricity stored in the electricity storage device to illuminate the illumination source of the Hot Surface Indicator includes supplying the stored predetermined amount of electricity to an amplifier to amplify the stored predetermined amount of electricity supplied to the illumination source of the Hot Surface Indicator.

12. A cooking appliance, comprising:

at least one burner operable in an ON condition for producing heat and an OFF condition for not producing heat;

a Hot Surface Indicator having an illumination source;

an electricity storage device sized to store a predetermined amount of electricity and configured to supply the predetermined amount of electricity until the electricity storage device is depleted to illuminate the illumination source of the Hot Surface Indictator independent of an actual temperature of a portion of the cooking appliance;

a switch electrically coupling the storage device to an electricity source; and a control selector operable between an ON state for placing the burner in the ON condition and an OFF state for placing the burner in the OFF condition, and activating the switch to electrically couple the electricity source to the electricity storage device when the control selector is in the ON state; and wherein the electricity storage device is sized so that the illumination source of the Hot Surface Indicator remains illuminated until the burner is cool enough to touch after the control selector is moved from the ON state to the OFF state.

13. The cooking appliance of claim 12 wherein the electricity storage device comprises a capacitor.

14. The cooking appliance of claim 13 wherein the electricity storage device comprises a resistor-capacitive circuit (RC circuit) and the capacitor forms part of the RC circuit.

15. The cooking appliance of claim 14, further comprising an op-amp operably coupled to the electricity source and the electricity storage device.

16. The cooking appliance of claim 15 wherein the electricity storage device is configured to supply a control signal to the op-amp.

17. The cooking appliance of claim 16 wherein the electricity source supplies electricity to the illumination source of the Hot Surface Indicator while the electricity storage device supplies the control signal.

18. The cooking appliance of claim 13 wherein the capacitor is sized to store the predetermined amount of electricity.

19. The cooking appliance of claim 18 wherein the capacitor is sized for the illumination source of the Hot Surface Indicator to remain illuminated until the burner is in the range of 25° C. -65° C.

20. The cooking appliance of claim 12, further comprising an ON Indicator having an illumination source, which is electrically coupled to the electricity source by the switch.

21. The cooking appliance of claim 20 wherein when the control selector is in the ON state, the switch electrically couples the electricity source to the illumination source of the ON Indicator.

* * * * *